United States Patent [19]

Matsumoto

[11] Patent Number: 5,015,512

[45] Date of Patent: May 14, 1991

[54] SOLDER-ENCLOSING HEAT-SHRINKABLE TUBE

[75] Inventor: Yasuyo Matsumoto, Osaka, Japan

[73] Assignee: Sumitomo Electric Industries, Ltd., Osaka, Japan

[21] Appl. No.: 426,646

[22] Filed: Oct. 26, 1989

[30] Foreign Application Priority Data

Oct. 26, 1988 [JP] Japan ..... 63-268149

[51] Int. Cl.[5] ..... H01R 4/02

[52] U.S. Cl. ..... 428/35.1; 174/DIG. 8; 174/84 R

[58] Field of Search ..... 174/84 R, DIG. 8; 428/34.9, 35.1

[56] References Cited

U.S. PATENT DOCUMENTS 4,271,330 6/1981 Watine et al. ..... 174/84 R
4,283,596 8/1981 Vidakovits et al. ..... 174/84 R
4,304,959 12/1981 Vidakovits et al. ..... 174/84 R
4,696,841 9/1987 Vidakovits ..... 174/84 R
4,832,248 5/1989 Soni et al. ..... 174/84 R

*Primary Examiner*—James J. Seidleck
*Attorney, Agent, or Firm*—Sughrue, Mion, Zinn, Macpeak & Seas

[57] ABSTRACT

A solder-enclosing heat-shrinkable tube comprising:

a heat-shrinkable tube comprising a first fluororesin;

a ring-shaped fusible solder inserted in the tube; and ring-shaped thermoplastic resin inserts placed in the tube on either side of the ring-shaped fusible solder;

wherein the ring-shaped thermoplastic resin inserts comprising a blend of (A) a second fluororesin analogues to the first fluororesin, and (B) an-ethylene-vinyl acetate copolymer compatible with the second fluororesin.

6 Claims, 1 Drawing Sheet

SOLDER-ENCLOSING HEAT-SHRINKABLE TUBE

FIELD OF THE INVENTION

The present invention relates to a solder-enclosing heat-shrinkable tube which is resistant to heat cycles and chemical action and does not deteriorate in its dielectric strength even under severe environmental conditions.

BACKGROUND OF THE INVENTION

Generally, tubes specified in MIL (U.S. military specifications) have been used for solder-enclosing heat-shrinkable tubes. The usual structure thereof is shown in FIG. 1: a ring-shaped solder 2 is placed inside the middle portion of a heat-shrinkable tube 1, and the inserts composed of ring-shaped thermoplastic resin 3 are placed inside the two end openings.

In practical operation, the portions of electric cables to be connected are inserted into the heat-shrinkable tube, and heat is applied. The heat shrinks the tube and simultaneously melts solder, thus, the electrical cables are connected. The heat also melts the ring-shaped thermoplastic resin inserts causing the thermoplastic resin to flow into any spaces between the electrical cable and the heat-shrinkable tube thus water-proofing the connection.

The ring-shaped thermoplastic resin inserts are generally made of polyethylene resins (hereinafter referred to as "PE") because of the water-proofness of these resins. PE resins, however, swell in water or melt at high temperatures. This lowers the inherent water-proofness of PE because the swelling and melting creates a tendency to evolve interstices and to damage the bonding with the heat-shrinkable fluororesin tube. This also reduces the high chemical resistance of PE resin at room temperature.

To avoid these disadvantages, materials analogous to the heat-shrinkable tube are proposed to use for the thermoplastic resin inserts. Fluororesins such as a vinylidene fluoride copolymer are known for this purpose. Use of a resin of similar or analogues type as the heat-shrinkable tube is considered to result in a satisfactory adhesion of the resin to the heat-shrinkable tube.

However, the electric cables used in the test in MIL-S83519 have an insulation layer made of an ethylenetetrafluoroethylene copolymer (hereinafter referred to as "ETFE") or a tetrafluoroethylene-hexafluoropropylene copolymer (hereinafter referred to as "FEP") to which the above-mentioned fluororesin used for the ring-shaped thermoplastic resin cannot be bonded satisfactory. Using these resin inserts, the tube may fail in the dielectric strength test after a heat cycle even though it may pass other tests such as the oil-resistance test.

The ring-shaped thermoplastic resin inserts used with the solder-enclosing heat-shrinkable tube must adhere strongly to both the heat-shrinkable tube and the electric cable since the ring-shaped resin insert is employed for water-proofing.

The electric cables used in the test of MIL-S-83519 are coated with ETFE or FEP type resin, and thus cannot be bonded well using conventional hot-melt type adhesive. Further, the ring-shaped resin insert must satisfactorily fill any interspace between the electric cable and the heat-shrinkable tube in order to assure water-proofness under a variety of test conditions such as of heat-resistance, oil-resistance, etc.

SUMMARY OF THE INVENTION

The present invention solves the problems mentioned above by use of a ring-shaped thermoplastic resin comprising a blend of materials that has both improved rubber elasticity and adhesive properties. This blend comprises a material analogous to the material of the heat-shrinkable tube and an ethylenevinyl acetate copolymer (hereinafter referred to as "EVA") which is compatible with the material and is highly resistant to chemicals. The term "compatible" used herein means "soluble in each other".

Accordingly to an aspect of the present invention, there is provided a solder-enclosing heat-shrinkable tube comprising a heat-shrinkable tube comprising a first fluororesin, a ring-shaped fusible solder inserted in the tube, and ring-shaped thermoplastic resin inserts placed on either side of the fusible solder in the tube; the ring-shaped thermoplastic resin inserts comprising a blend of (A) a second fluororesin analogous to the first fluororesin constituting the heat-shrinkable tube and (B) an ethylene-vinyl acetate copolymer having compatibility with the fluororesin (A).

The blend constituting the ring-shaped thermoplastic resin may preferably comprise (A) from 30 to 90 parts by weight of a polyvinylidene fluoride, a terpolymer of vinylidene fluoride/hexafluoropropylene/tetrafluoroethylene, and/or a copolymer of vinylidene fluoride/-hexafluoropropylene, and (B) from 70 to 10 parts by weight of an ethylene/vinylacetate copolymer containing from 25 to 50 wt% of vinyl acetate.

DETAILED DESCRIPTION OF THE INVENTION

Figure 1:
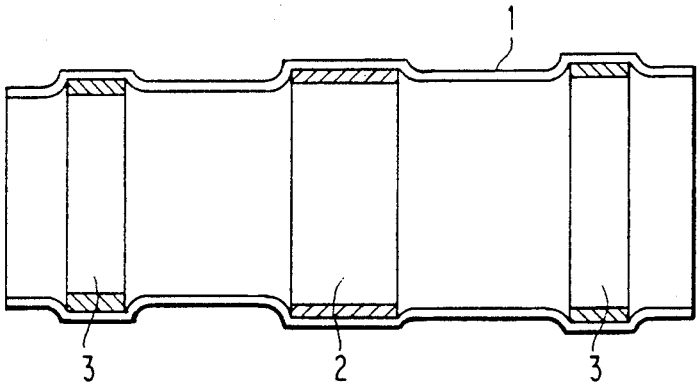
FIG. 1 is a cross-sectional view showing the structure of a solder-enclosing heat-shrinking tube.

The material constituting the heat-shrinkable tube 1 of the solder-enclosing heat-shrinkable tube of the present invention comprises, as a main component, a heat-resistant and oil-resistant fluororesin (first fluororesin) (including an elastomer), which may be blended, if necessary, with an additional thermoplastic resin such as polyethylene, polypropylene and the like within a range where the performance of the fluororesin is not impaired thereby.

The first fluororesin is preferably at least one of polyvinylidene fluoride, a copolymer of vinylidene fluoride/hexafluoropropylene, and a terpolymer of vinylidene fluoride/hexafluoropropylene/tetrafluoroethylene.

The ring-shaped thermoplastic resin inserts 3 of the present invention are placed in the end opening of the heat-shrinkable tube 1 as shown in FIG. 1. These ring-shaped thermoplastic resin inserts comprise a blend made by mixing the component (A) (second fluororesin) and the component (B). The component (A) may be any material analogous to the first fluororesin constituting the heat-shrinkable tube, preferably a polyvinylidene fluoride, a terpolymer of vinylidiene fluoride/hexafluoropropylene/tetrafluoroethylene, and/or a copolymer of vinylidene fluoride/hexafluoropropylene.

The component (B) is an ethyl vinyl acetate copolymer, that is compatible with the component (A). The EVA preferably contains from 25 to 50 wt%, more preferably from 30 to 40 wt% of vinyl acetate from the view point of the compatibility with the component (A). The EVA may also be a copolymer containing a small amount of an olefinic compound as a third component such as hydrophilic methacrylic acid, vinyl chloride, and maleic anhydride, or may be a graftmer in which such a third component is grafted on the EVA.

EVA having a vinyl acetate content of less than 25 parts by weight may not attain the desired object because of its reduced compatibility with component (A) and its reduced elasticity. EVA having a vinyl acetate content of higher than 50 parts by weight may be difficult to mold because of its excessive stickiness.

The blending ratio of the component (A) to the component (B) is set within the range where the intended object can be achieved: preferably from 30 to 90 parts by weight of (A) and from 70 to 10 parts by weight of (B); and more preferably from 40 to 80 parts by weight of (A) and from 60 to 20 parts by weight of (B) may be employed.

While the ring-shaped thermoplastic resin insert containing the component (A) (second fluororesin) in a content of 90 parts by weight or more can be fusion-bonded to the heat-shrinkable thermoplastic resin on heat-shrinking, it tends to deteriorate and lose its dielectric strength after a heat cycle of −65° C. to 150° C. Accordingly it will not satisfy the specification of MIL-S-83519 standard. This is because interstices evolve at the interface between the coating of ETFE or FEP type fluororesin of the electric cable and the ring-shaped insert due to the insufficient content of EVA component (B) which imparts rubber elasticity. The resulting voltage drop during the dielectric strength test is due to the penetration of water into these interstices.

On the other hand, the ring-shaped thermoplastic resin inserts containing the fluororesin (A) at a content of as low as less than 30 parts by weight tends to do not exhibit satisfactory performance such as in heat-resistance.

The ring-shaped thermoplastic resin insert of the present invention may contain, if required, a small amount (preferably 20 wt% or less) of any other thermoplastic resin or an additive.

The solder enclosing heat-shrinkable tube of the present invention is manufactured through the steps below:

(1) A thermoplastic tube is prepared from a fluororesin material by extrusion molding or other molding means; the material of the tube is crosslinked as required by chemical action or electron beam radiation; the tube is expanded, for example, by applying inner pressure following heating to a temperature higher than the softening temperature of the tube material; the tube is cooled and fixed.

(2) A ring-shaped solder is inserted in the inner middle position of the heat-shrinkable tube.

(3) One thermoplastic resin insert is placed into each end of the heat-shrinkable tube.

The solder-enclosing heat-shrinkable tube of the present invention is useful for coupling or splicing electric cables.

The present invention employs mixedly a fluororesin (A), in particular a terpolymer composed of polyvinylidene fluoride/hexafluoropropylene/tetrafluoropropylene and/or a copolymer composed of vinylidene fluoride/hexafluoropropylene, which is analogues to the fluororesin of the heat-shrinkable tube, in combination with EVA (B) which is compatible with the component (A) and has satisfactory oil resistance and stickiness for the purpose of securing heat-resistance and oil resistance as specified by MIL-S-83519 standard. Thus the present invention can provide a solder-enclosing heat-shrinkable tube constructed to prevent the formation of interstices during periods of heating and cooling at the interface of electrical cable and the ring-shaped insert.

The present invention is described more specifically in the following examples which are given only for illustration of the invention and are not intended as limiting.

EXAMPLES

A heat-shrinkable tubes having an inside diameter of 6.0 mm, a thickness of 0.2 mm, and a tube length of 17 mm was prepared using a vinylidene fluoride/hexafluoropropylene copolymer (made by Pennwalt Co., Ltd.: Kynar 2800). A solder ring was inserted in the middle portion of the heat-shrinkable tube, and a thermoplastic resin ring insert having a width of 2 mm and a thickness of 0.3 mm was inserted in each end of the tube to prepare a solder-enclosing heat-shrinkable tube. The final product was tested according to MIL-S-83519.

The test items according to MIL-S-83519 were as below:

(1) Dielectric strength after heat cycle

Dielectric strength after 10 cycles was measured, in which one cycle consists of treatments at −65° C. for 30 minutes, at 25° C. for 5 minutes, at 150° C. for 30 minutes, and at 25° C. for 5 minutes.

(2) Dielectric strength after aging

Dielectric strength after aging test of 150° C. for 750 hours was measured.

(3) Dielectric strength after oil resistance test

Dielectric strength after 7 cycles of the oil resistance tests, with one cycle comprising treatments at 150° C. for 5 minutes, at 23° C. for 1 hour, and at 175° C. for 22 hours in the oil specified in MIL-L-7808.

The results obtained are shown in Table 1 below.

TABLE 1

| | Example | | Comparative example | |
|---|---|---|---|---|
| | 1 | 2 | 1 | 2 |
| Composition of ring-shaped thermoplastic resin (part by weight) | | | | |
| Kainer 2812 (A) | 50 | 60 | 100 | — |
| EVA 1 (B) | 50 | — | — | 100 |
| EVA 2 (B) | — | 40 | — | — |
| Dielectric strength | | | | |
| After heat cycles | pass | pass | fail | fail |
| After aging | pass | pass | pass | fail |
| After oil resistance test | pass | pass | pass | fail |

Remark:
(1) Kynar 2812: Vinylidene fluoride/hexafluoropropylene copolymer made by Pennwalt Co.
(2) EVA 1: Ethylene/vinyl acetate copolymer having a vinyl acetate content of 41 wt % made by Mitsui Polychemicals Co., Ltd.
(3) EVA 2: Ethylene/vinyl acetate copolymer having a vinyl acetate content of 33 wt % made by Mitsui Polychemicals Co., Ltd.

It is clear from the results in Table 1 that the solder-enclosing heat-shrinkable tubes according to the present invention are excellent in all the dielectric strengths after heat cycles, after aging and after oil resistance test.

While the invention has been described in detail and with reference to specific examples thereof, it will be apparent to one skilled in the art that various changes and modifications can be made therein without departing from the spirit and scope thereof.

What is claimed is:

1. A solder-enclosing heat-shrinkable tube comprising:

a heat-shrinkable tube comprising a first fluororesin;

a ring-shaped fusible solder inserted in said tube; and ring-shaped thermoplastic resin inserts placed in said tube on either side of said ring-shaped fusible solder;

wherein said ring-shaped thermoplastic resin inserts comprising a blend of (A) a second fluororesin analogues to said first fluororesin, and (B) an ethylene-vinyl acetate copolymer compatible with said second fluororesin.

2. A solder enclosing heat-shrinkable tube as claimed in claim 1, wherein said first fluororesin and said second fluororesin each comprises at least one of: a polyvinylidene fluoride, a terpolymer of vinylidene fluoride/hexafluoropropylene/tetrafluoroethylene, and a copolymer of vinylidene fluoride/hexafluoropropylene.

3. A solder enclosing heat-shrinkable tube as claimed in claim 1, wherein said ethylene-vinyl acetate copolymer contains from 25 to 50 wt% of vinyl acetate.

4. A solder enclosing heat-shrinkable tube as claimed in claim 3, wherein said ethylene-vinyl acetate copolymer contains from 30 to 40 wt% of vinyl acetate.

5. A solder enclosing heat-shrinkable tube as claimed in claim 2, wherein said blend comprises (A) from 30 to 90 parts by weight of said second fluororesin, and (B) from 70 to 10 parts by weight of said ethylene/vinylacetate copolymer.

6. A solder enclosing heat-shrinkable tube as claimed in claim 5, wherein said blend comprises (A) from 40 to 80 parts by weight of said second fluororesin; and (B) from 60 to 20 parts by weight of said ethylene/vinylacetate copolymer.

* * * * *